US009028218B2

(12) United States Patent
Asai et al.

(10) Patent No.: US 9,028,218 B2
(45) Date of Patent: May 12, 2015

(54) STEAM TURBINE

(75) Inventors: Kunio Asai, Hitachi (JP); Keiko Shishime, Hitachinaka (JP); Yasuyoshi Harashima, Hitachi (JP); Takeshi Kashiwagi, Iwaki (JP); Hideyuki Nomura, Hitachi (JP); Takafumi Wakasa, Hitachinaka (JP); Masayoshi Ohhira, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 435 days.

(21) Appl. No.: 13/483,181

(22) Filed: May 30, 2012

(65) Prior Publication Data

US 2012/0308390 A1 Dec. 6, 2012

(30) Foreign Application Priority Data

Jun. 3, 2011 (JP) ..... 2011-125593

(51) Int. Cl.
*F01D 5/30* (2006.01)
*F01D 5/28* (2006.01)
*F01D 5/32* (2006.01)

(52) U.S. Cl.
CPC ..... *F01D 5/3053* (2013.01); *F01D 5/28* (2013.01); *F01D 5/30* (2013.01); *F01D 5/32* (2013.01); *F05D 2300/133* (2013.01); *F05D 2300/174* (2013.01)

(58) Field of Classification Search
CPC ..... F01D 4/30; F01D 4/3023; F01D 4/3053; F01D 4/32; F01D 4/323; F01D 4/326
USPC ..... 416/215, 217, 218, 219 R, 220 R, 241 A
See application file for complete search history.

(56) References Cited

U.S. PATENT DOCUMENTS

2002/0057969 A1* 5/2002 Namura et al. ..... 416/238
2008/0181808 A1* 7/2008 Thamboo et al. ..... 420/419

(Continued)

FOREIGN PATENT DOCUMENTS

CN 101235449 A 8/2008
EP 1 953 251 A1 8/2008

(Continued)

OTHER PUBLICATIONS

Korean Office Action with Partial English Translation dated Jun. 21, 2013 (Nine (9) pages).

(Continued)

*Primary Examiner* — Dwayne J White
*Assistant Examiner* — William Grigos
(74) *Attorney, Agent, or Firm* — Crowell & Moring LLP

(57) ABSTRACT

A steam turbine having a fork-type joint structure is provided that secures sufficient strength for endurance of stress corrosion cracking, low-cycle fatigue, and high-cycle fatigue, and extends an operating life while making it possible to endure long-term operation. The turbine includes a rotor having a plurality of rotor forks rowed in an axial direction; a turbine blade having blade forks arranged in the axial direction of the rotor, the blade forks engaged with the rotor forks; a plurality of pin holes whose positions are different from each other in the radial direction of the rotor; and a plurality of fork pins inserted into the plurality of pin holes in the axial direction of the rotor. A clearance exists between an inner diameter of the pin hole of the blade fork and a diameter of the fork pin, the clearance varying depending on positions in the axial direction of the turbine.

6 Claims, 6 Drawing Sheets

(56) References Cited

U.S. PATENT DOCUMENTS

| | | | | |
|---|---|---|---|---|
| 2010/0232969 | A1* | 9/2010 | Behnke et al. | 416/204 R |
| 2014/0064977 | A1* | 3/2014 | Buguin et al. | 416/220 R |

FOREIGN PATENT DOCUMENTS

| | | | |
|---|---|---|---|
| JP | 53-74606 | A | 3/1978 |
| JP | 63-248901 | A | 10/1988 |
| JP | 2001-12208 | A | 1/2001 |
| JP | 2001-193406 | A | 7/2001 |
| JP | 2010-43595 | A | 2/2010 |
| JP | 2010-216469 | A | 9/2010 |

OTHER PUBLICATIONS

Japanese Office Action with partial English translation dated Jul. 23, 2013.

Extended European Search Report dated Nov. 14, 2013 (9 pages).

* cited by examiner

STEAM TURBINE

BACKGROUND OF THE INVENTION

1. Field of the Invention

The present invention relates to a steam turbine provided with a fork-type blade attachment.

2. Description of the Related Art

A fork-type blade attachment is used as a structure for joining a turbine blade and a turbine rotor. The structure of the fork-type blade attachment is as follows. Blade forks formed in the lower portion of a turbine blade and rotor forks formed on a turbine rotor are alternately combined with each other. Then, a plurality of fork pins whose positions are different from one another in radial direction of the turbine rotor are axially inserted into the turbine rotor to join the blade forks and the rotor forks. Conventionally, the diameter of the fork pin is axially constant and also the inner diameter of the pin hole is axially constant.

The structure of the fork-type blade attachment is characterized by the capability of bearing high centrifugal force which, due to this feature, is often adopted by a low-pressure last stage of a steam turbine or the stage ahead of the last stage. These stages are subjected to application of vibration force under the high centrifugal force. In addition, the stages are in a corrosion environment in which a trace of corrosion impurities is contained in steam condense. Therefore, the structure of the fork-type blade attachment has to secure sufficient strength for endurance of stress corrosion cracking, low-cycle fatigue resulting from start-stop and high-cycle fatigue under high mean stress.

Known technologies for strength enhancement include executing shot peening or laser peening for a pin hole to apply compressive residual stress thereto (see e.g. JP-63-248901-A and JP-2010-43595-A). JP-2001-12208-A describes that a solid lubrication film is applied to a pin hole to lower a friction coefficient, thereby extending an operating life.

SUMMARY OF THE INVENTION

With the methods described above, a sufficient effect can be expected immediately after the execution thereof. However, there is a problem that the sustainability of the effects during the long period of operation is not necessarily secured. For example, if the long period of operation for ten years or more is considered, there is a possibility that the absolute value of the applied compressive residual stress is reduced or that the durable years of the lubricating film can be expired.

As described above, the fork-type blade attachment adopted by the low-pressure last stage of a steam turbine or the stage ahead of the last stage requires securement sufficient strength for endurance of stress corrosion cracking, low-cycle fatigue resulting from start-stop and high-cycle fatigue under high mean stress. In addition, the fork-type blade attachment requires extending of the operating life while making it possible to sustain the effects for a long time.

The present invention has been made in view of such circumstances and aims to provide a steam turbine having a fork-type joint structure that secures sufficient strength for endurance of stress corrosion cracking, low-cycle fatigue and high-cycle fatigue and extends an operating life while making it possible to endure long-term operation.

In accordance with a first aspect of the present invention, a steam turbine includes a turbine rotor having a plurality of rotor forks rowed in an axial direction; a turbine blade having blade forks rowed in the axial direction of the turbine rotor, the blade forks engaged with the rotor forks; a plurality of pin holes whose positions are different from each other in the radial direction of the turbine rotor; and a plurality of fork pins inserted into the plurality of pin holes in the axial direction of the turbine rotor, the plurality of fork pins each for joining the rotor fork and the blade fork; wherein a clearance is defined between an inner diameter of the pin hole of the blade fork and a diameter of the fork pin and the clearance varies depending on positions in the axial direction of the turbine rotor.

In accordance with a second aspect of the present invention, a steam turbine includes a turbine rotor having a plurality of rotor forks rowed in an axial direction; a turbine blade having blade forks rowed in the axial direction of the turbine rotor, the blade forks engaged with the rotor forks; a plurality of pin holes whose positions are different from each other in the radial direction of the turbine rotor; and a plurality of fork pins inserted into the plurality of pin holes in the axial direction of the turbine rotor, the plurality of fork pins each for joining the rotor fork and the blade fork; wherein a diameter of the fork pin varies depending on a position in the axial position of the turbine rotor.

In accordance with a third aspect of the present invention, in the first aspect of the present invention, preferably, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and at least one of a plurality of pin holes different in radial position of the blade fork is formed so that a clearance between an inner diameter of a pin hole at the steam inlet end of the blade fork and a diameter of the fork pin is formed greater than a clearance between an inner diameter of a pin hole at a portion that differs in axial position of the blade fork and the diameter of the fork pin.

In accordance with a forth aspect of the present invention, preferably, in the second aspect of the present invention, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and a fork pin inserted into at least one of a plurality of pin holes different in radial position of the blade fork is formed so that the diameter of the fork pin at the steam inlet end of the blade fork is smaller than the diameter of the fork pin at a portion that differs in axial position of the blade fork.

In accordance with a fifth aspect of the present invention, in the first aspect of the present invention, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and at least one of a plurality of pin holes different in radial position of the blade fork is formed so that a clearance between an inner diameter of a pin hole at the steam outlet end of the blade fork and a diameter of the fork pin is formed greater than a clearance between an inner diameter of a pin hole at a portion that differs in axial position of the blade fork and the diameter of the fork pin.

In accordance with a sixth aspect of the present invention, in the second aspect of the present invention, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and a fork pin inserted into at least one of a plurality of pin holes different in radial position of the blade fork is formed so that a diameter of the fork pin at the steam outlet end of the blade fork is smaller than the diameter of the fork pin at a portion that differs in axial position of the blade fork.

In accordance with a seventh aspect of the present invention, the fork pin has a small-diameter portion, the small-diameter portion including a parallel portion formed with an axially constant diameter and a tapered portion formed to increase a diameter in an axial direction from the parallel portion, and an intersection between the parallel portion and the tapered portion is smoothly and circularly processed.

In accordance with an eighth aspect of the present invention, in the portion where the clearance between the inner diameter of the pin hole of the blade fork and the diameter of the fork pin is greatly formed, a value obtained by dividing the clearance by a maximum diameter of the fork pin is between 0.984 and 0.992.

In accordance with a ninth aspect of the present invention, preferably, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and a fork pin inserted into an least one of a plurality of pin holes different in radial position of the blade fork is such that a value obtained by dividing a axial distance between a start point from which a pin-diameter starts to reduce in an axial direction and the steam outlet end of the blade fork by an axial width of the blade fork is between 0.3 and 0.6.

In accordance with a tenth aspect of the present invention, preferably, a platform of the turbine blade has an axial central portion located closer to a circumferential convex side than an axial steam inlet end and an axial steam outlet end; the steam turbine further includes a blade fork formed in a region where a circumferential position of the platform of the turbine blade is changed between the axial steam inlet end and the axial central portion; and a fork pin inserted into at least one of a plurality of pin holes different in radial position of the blade fork is such that a value obtained by dividing a axial distance between a start point from which a pin-diameter starts to reduce in an axial direction and the steam inlet end of the blade fork by an axial width of the blade fork is between 0.3 and 0.6.

In accordance with an eleventh aspect of the present invention, preferably, the turbine blade is made of a titanium alloy.

According to the present invention, the blade fork formed in the region where the platform of the turbine blade is changed in circumferential position between the steam inlet end and the axial central portion and between the steam outlet end and the axial central portion is such that the load shared by the portion where the convex side circumferential width of the blade fork is narrower than the concave side width can be reduced to reduce the local stress of the pin hole. Thus, the steam turbine provided with the fork-type blade attachment can be provided that has highly-reliability on low-cycle fatigue and stress corrosion cracking and extends an operating life.

DESCRIPTION OF THE PREFERRED EMBODIMENTS

Preferred embodiments of a steam turbine according to the present invention will hereinafter be described with reference to the drawings.

First Embodiment

Figure 1:
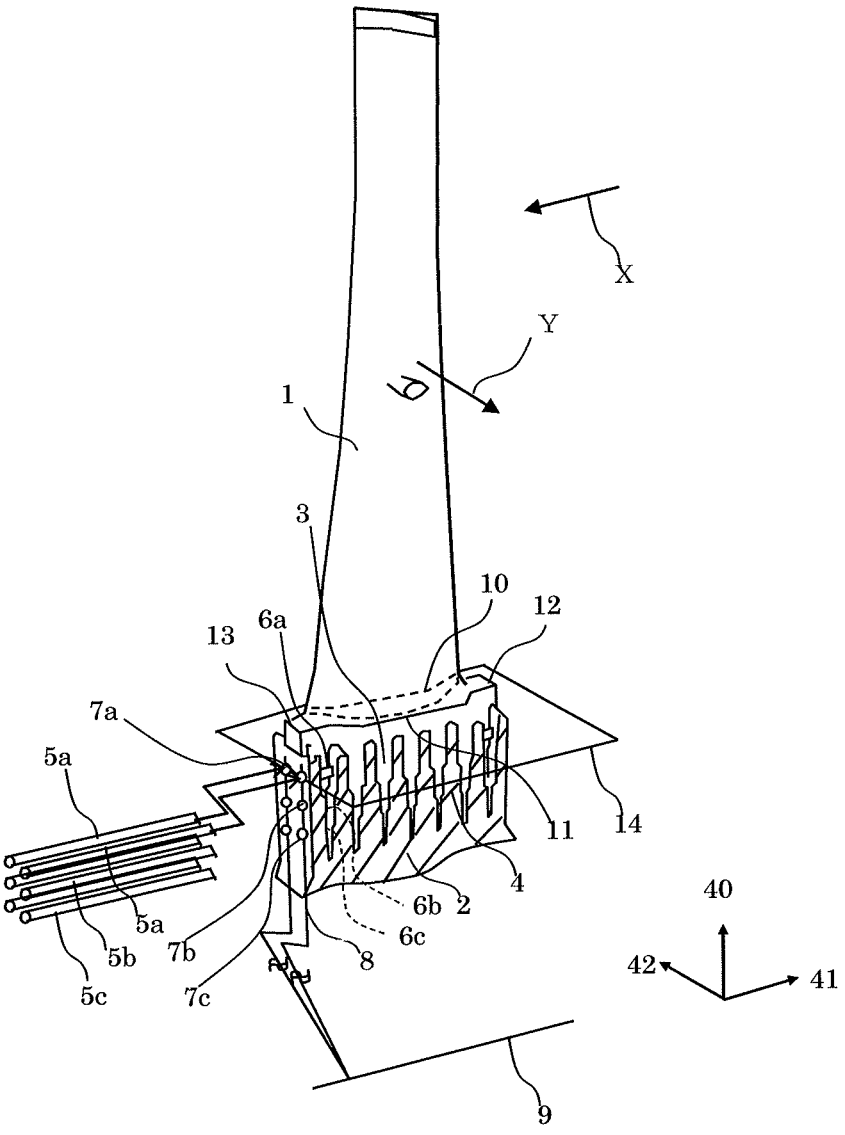
FIG. 1 is a perspective view of a joint structure of a turbine blade and a turbine rotor of the steam turbine according to a first embodiment of the present invention.
Figure 2:
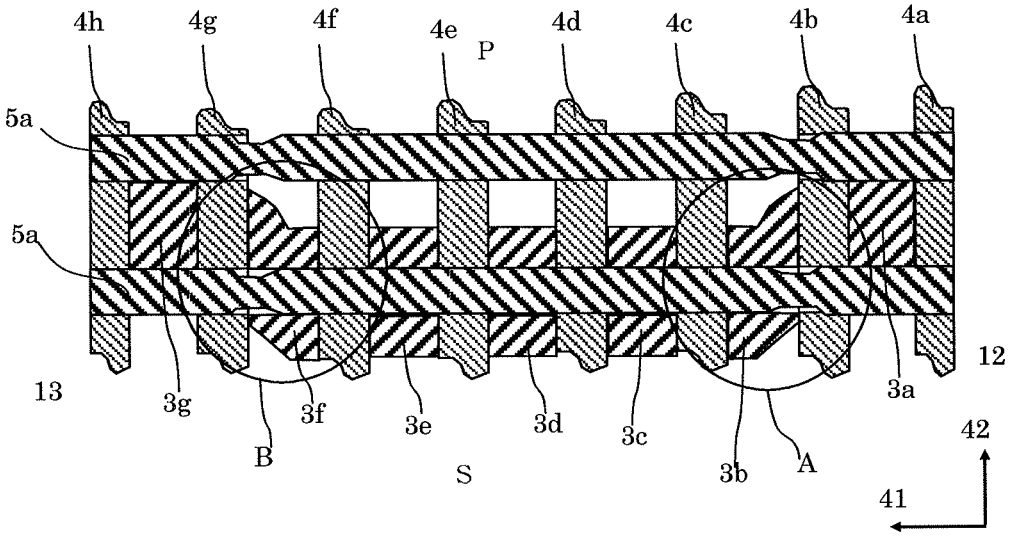
FIG. 2 is a transverse cross-sectional view of the joint structure of the turbine blade and the turbine rotor of the steam turbine according to the first embodiment.
Figure 3:
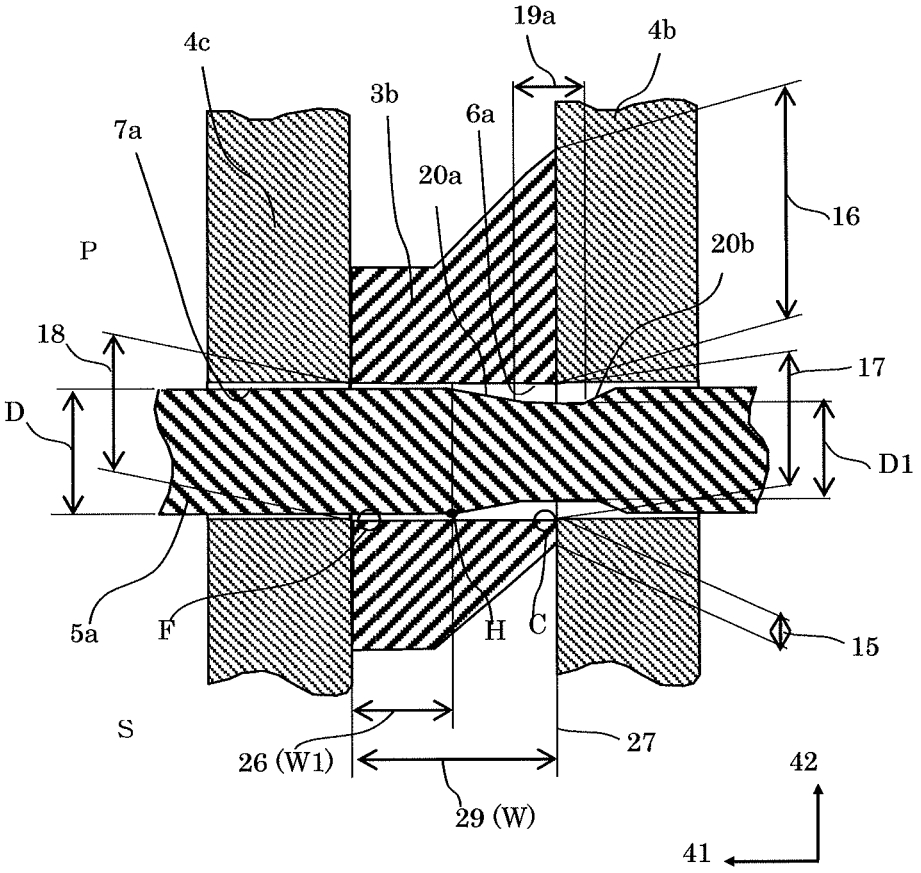
FIG. 3 is a transverse cross-sectional view showing an enlarged A-portion of the joint structure of the turbine blade and the turbine rotor shown in FIG. 2.
Figure 4:
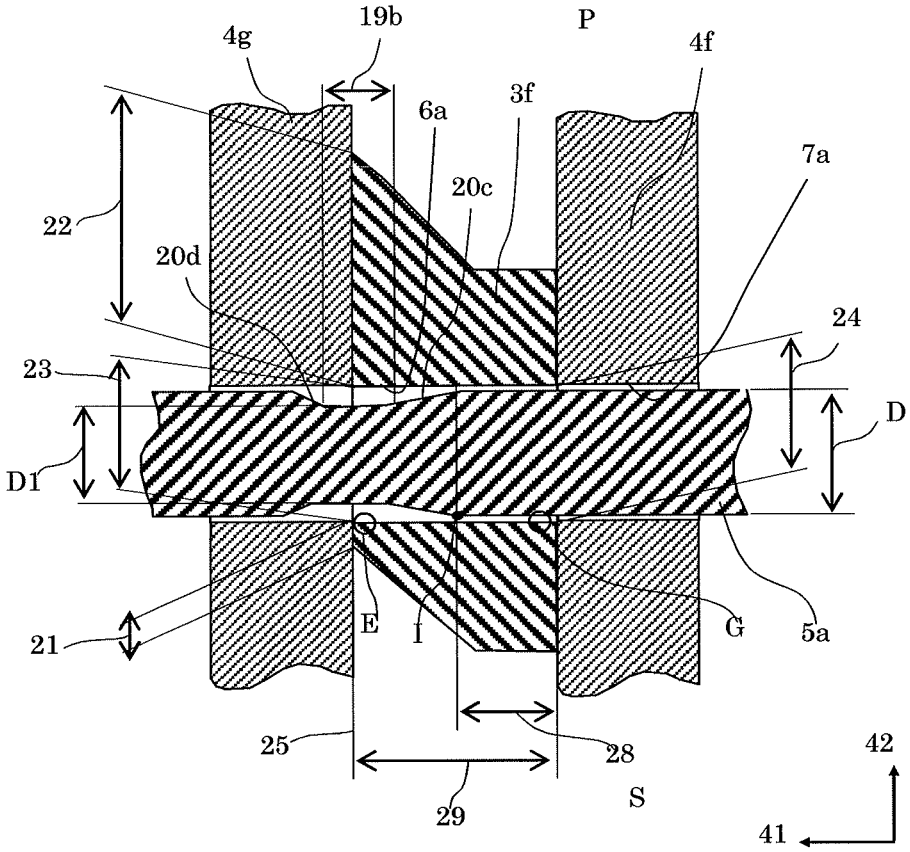
FIG. 4 is a transverse cross-sectional view of an enlarged B-portion of the joint structure of the turbine blade and the turbine rotor shown in FIG. 2.

FIG. 1 is a perspective view of a joint structure of a turbine blade and a turbine rotor of the steam turbine according to a first embodiment of the present invention. FIG. 2 is a transverse cross-sectional view of the joint structure of a turbine blade and a turbine rotor of the steam turbine according to the first embodiment. FIG. 3 is a transverse cross-sectional view showing an enlarged A-portion of the joint structure of the turbine blade and the turbine rotor shown in FIG. 2. FIG. 4 is a transverse cross-sectional view of an enlarged B-portion of the joint structure of the turbine blade and the turbine rotor shown in FIG. 2.

Referring to FIG. 1, a fork-type blade attachment has a plurality of blade forks 3 located in a lower portion of the turbine blade 1, and a plurality of rotor forks 4 formed on the turbine rotor 2 and engaged with the blade forks 3. The blade forks 3 are formed with pin holes 6*a*, 6*b*, 6*c* and the rotor forks 4 are formed with pin holes 7*a*, 7*b*, 7*c*. Fork pins 5*a*, 5*b*, 5*c* (six fork pins are used in the embodiment) are inserted into the corresponding pin holes 6*a*-6*c*, 7*a*-7*c* in the axial direction of the turbine rotor. Centerlines 8 of the six fork pins 5*a*-5*c* are arranged at intervals on corresponding lines in a radial direction 40 passing through a centerline 9 of the turbine rotor 2. Incidentally, steam flows toward the turbine blade in a direction denoted by arrow X to rotate the turbine blade 1 and the turbine rotor 2 in a direction of arrow Y.

A profile 10 of a root section of the turbine blade 1 has an arc shape. Therefore, an axial central portion 11 of a platform (a proximal end) of the turbine blade 1 is located closer to a convex side (the end side of the arrow Y indicating the rotating direction of the turbine blade 1), in a circumferential direction 42, than an axial inlet end 12 and an axial outlet end 13.

A transverse cross-section showing the joint structure of the turbine blade 1 and the turbine rotor 2 in FIG. 2 has a shape of a cross-section 14 perpendicular to the radical direction 40 on the centerline of a fork pin 5*a* located at the circumferentially outermost position of the radial direction 40 in FIG. 1. In FIG. 2, the convex side in the circumferential direction 42 is denoted by symbol S and the concave side in the circumferential direction 42 is denoted by symbol P. Incidentally, when the number of the blade forks 3 is n, the blade forks 3 are sequentially numbered from the steam inlet side to the steam outlet side. Specifically, the blade fork 3 on the steam inlet side is defined as the fork number 1 and the blade fork 3 on the steam outlet side is defined as the fork number n. In addition, when the number of the rotor forks 4 is m, similarly the rotor forks 4 are sequentially numbered from the steam inlet side to the steam outlet side. The rotor fork 4 on the steam outlet side is defined as the number m. FIG. 2 shows an example in which the number of the blade forks 3 is seven in the axial direction 41 of the turbine rotor 2 and the number of the rotor forks 4 is eight in the axial direction 41 of the turbine rotor 2.

In FIG. 2, the blade fork 3*a* of the fork number 1 and the blade fork 3*g* of the fork number n are each such that the fork pins 5*a*, 5*a* are disposed at both a convex (S) side end and a concave (P) side end. The blade forks 3*c*-3*e* of fork numbers 3-(*n*−2) are each such that the fork pin 5*a* is disposed to pass through the general center, in the circumferential direction 42, of each of the blade forks 3*c*-3*e*.

The second blade fork 3*b* of the second fork number 2 from the steam inlet side is formed in a region where the position, in the circumferential direction 42, of the platform of the turbine blade 1 is changed between the axial inlet end 12 and the axial central portion 11. This case has the constructional restrictions. Therefore, as shown in FIG. 3, i.e., a detailed view of an A-portion in FIG. 2, a circumferential width 15 of the convex (S) side end surface at the steam inlet end of the blade fork 3*b* of the fork number 2 is smaller than a circumferential width 16 of the concave (P) side end surface. Since the narrow circumferential width 15 has low rigidity, a stress concentration factor tends to increase at a C-point on the end side of the pin hole 6*a* shown in FIG. 3.

A clearance (17-D1) is defined between an inner diameter 17 of the pin hole 6*a* at the steam inlet end of the blade fork 3*b* of the fork number 2 having a asymmetrical shape as described above and a diameter D1 of the fork pin 5*a* at the steam inlet end of the blade fork 3*b* of the fork number 2. In addition, a clearance (18-D) is defined between an inner diameter 18 of the pin hole 6*a* at the outlet end of the blade fork 3*b* of the fork number 2 and a diameter D of the fork pin 5*a*. The features of the present invention lie in that the clearance (17-D1) is formed greater than the clearance (18-D).

The present embodiment shows the following case. The inner diameter 17 of the pin hole 6*a* at the steam inlet end of the blade fork 3*b* of the fork number 2 is equal to the inner diameter 18 of the pin hole 6*a* at the steam outlet end. Therefore, the diameter D1 of the fork pin 5*a* at the steam inlet end of the blade fork 3*b* of the fork number 2 is smaller than the diameter D of the steam outlet end.

The fork pin 5*a* has a small pin-diameter region formed with a parallel portion 19*a* having a certain length in the axial direction 41. A boundary 27 between the blade fork 3*b* of the fork number 2 and the rotor fork 4*b* of the fork number 2 is disposed to face within the range of the parallel portion 19*a* formed with the small pin-diameter. The fork pin 5*a* is formed with tapered portions 20*a*, 20*b* gradually increased in pin-diameter from the parallel portion 19*a* in the axial direction 41. Between each of the tapered portions 20*a*, 20*b* and the parallel portion 19*a* of the small-pin-diameter region is smoothly and circularly processed in order to reduce the stress concentration factor of the fork pin 5*a*.

The application of the above-mentioned tapered pin structure to the fork pin 5*a* reduces a load shared at the steam inlet end of the blade fork 3*b* of the fork number 2 compared with that of the conventional technology in which a pin-diameter is constant in the axial direction 41. Consequently, this produces an effect of reducing local stress at the C-point at which the pin hole 6*a* has a narrow width in the circumferential direction 42. The reduction in local stress produces an effect of extending an operating life with respect to stress corrosion cracking, low-cycle fatigue resulting from start-stop and high-cycle fatigue under high mean stress. The parallel portion 19*a* formed with the small pin-diameter is located at a position facing the boundary 27 between the blade fork 3*b* of the fork number 2 and the rotor fork 4*b* of the fork number 2. Therefore, an effect of reducing more local pressure can be expected compared with the absence of the parallel portion 19*a*.

Returning to FIG. 2, a second blade fork 3*f* of the fork number (n−1) from the steam outlet side is formed in a region where the position, in the circumferential direction 42, of the platform of the turbine blade 1 is changed between the axial outlet end 13 and the axial central portion 11. This case has the constructional restrictions. Therefore, as shown in FIG. 4, i.e., a detailed view of a B-portion in FIG. 2, a circumferential width 21 on the convex (S) side of the steam outlet end surface of the blade fork 3*f* of the fork number (n−1) is formed narrower than the circumferential width 22 on the concave (P) side. Thus, a stress concentration factor tends to increase at an E-point of the pin hole 6*a* shown in FIG. 4.

A clearance (23-D1) is defined between an inner diameter 23 of the pin hole 6*a* at the steam outlet end of the blade fork 3*f* of the fork number (n−1) having a asymmetrical shape as described above and a diameter D1 of the fork pin 5*a* at the steam outlet end of the blade fork 3*f* of the fork number (n−1). In addition, a clearance (24-D) between an inner diameter 24 of the pin hole 6*a* at the inlet end of the blade fork 3*f* of the fork number (n−1) and a diameter D of the fork pin 5*a*. The features of the present invention lie in that the clearance (23-D1) is formed greater than the clearance (24-D).

It is desirable that the tapered pin shape of the blade fork 3*f* of the fork number (n−1) be symmetrical to the shape of the blade fork 3*b* of the fork number 2 mentioned above in the axial direction 41. More specifically, the fork pin 5*a* has a small pin-diameter region formed with a parallel portion 19*b* having a certain length in the axial direction 41. A boundary 25 between the blade fork 3*f* of the fork number (n−1) and the rotor fork 4*g* of the fork number (m−1) is disposed to face the within the range of the parallel portion 19*b* formed with the small pin-diameter. The fork pin 5*a* is formed with tapered portions 20*c*, 20*d* gradually increased in pin-diameter from the parallel portion 19*b* in the axial direction 41. Between each of the tapered portions 20*a*, 20*b* and the parallel portion 19*a* of the small pin-diameter region is smoothly and circularly processed in order to reduce the stress concentration factor of the fork pin 5*a*.

The application of the above-mentioned tapered pin structure produces an effect of reducing local stress at the E-point of the pin hole 6*a* having a narrow width in the circumferential direction 42 similarly to the blade fork 3*b* of the fork number 2.

Even if a fork pin 5*a* is adopted in which only a portion corresponding to the blade fork 3*b* of the fork number 2 is tapered, the stress reduction effect can be produced. However, in this case, the local stress at the E-point of the pin hole 6*a* of the blade fork 3*f* of the fork number (n−1) may probably increase. Therefore, it is desirable to adopt the fork pin 5*a* in which both the portions corresponding to the blade fork 3*b* of the fork number 2 and to the blade fork 3*f* of the fork number (n−1) are tapered. The tapered pin is shaped symmetrically in the axial direction 41 as described above. Therefore, it is possible to prevent the fork pin 5*a* from being inserted in the erroneous directions with respect to the inlet end 12 and outlet end 13 thereof.

It is desirable that a value of D1/D, i.e., a ratio of the diameter D1 at a portion where the diameter of the fork pin 5*a* is formed small, to the maximum diameter D be between 0.984 and 0.992. If the value of D1/D is smaller than 0.984, there is a problem in that the sufficient stress reduction effect cannot be produced at the stress concentration portion, i.e., at the C-point or E-point of the pin hole 6*a*, where the circumferential width of the blade fork 3*b* of the fork number 2 or the blade fork 3*f* of the fork number (n−1) is narrow. On the other hand, if the value of D1/D is greater than 0.992, the contact width in the axial direction 41 between the pin hole 6*a* of the blade fork 3*b* of the fork number 2 and the fork pin 5*a* is narrow. Therefore, there is a problem in that local stress is increased at an F-point of a portion on the side opposite, in the axial direction 41, to the C-point of the pin hole 6*a*. Similarly, the contact width, in the axial direction 41, is narrowed between the pin hole 6*a* of the blade fork 3*f* of the fork number (n−1) and the fork pin 5*a*. Therefore, there is a problem in that local stress is increased at a G-point, i.e., at a portion opposite, in the axial direction 41, to an E-point of the pin hole 6*a*.

In the blade fork 3*b* of the fork number 2 shown in FIG. 3, a distance 26, in the axial direction 41, between a point H from which the diameter of the fork pin 5*a* starts to decrease in the axial direction and the steam inlet end of the blade fork 3*b* of the fork number 2 is defined as a size W1. In addition, a width 29, in the axial direction 41, of the blade fork 3*b* of the fork number 2 is defined as a size W. In this case, it is desirable the ratio, i.e., a value of W1/W be between 0.3 and 0.6. Similarly, in the blade fork 3*f* of the fork number (n−1) shown in FIG. 4, a distance 28, in the axial direction 41, between I-point from which the diameter of the fork pin 5*a* starts to decrease in the axial direction and the steam inlet end of the blade fork 3*f* of the fork number (n−1) is defined as a size W1. In addition, a width 29, in the axial direction 41, of the blade fork 3*f* of the fork number (n−1) is defined as a size W. In this case, it is desirable that the ratio, i.e., a value of W1/W be between 0.3 and 0.6. If the value of W1/W is smaller than 0.3, then there is a problem in that a sufficient stress reduction effect cannot be produced at the stress concentration portion of the C-point or E-point of the pin hole 6*a* where the circumferential width of the blade fork 3*b* of the fork number 2 or the blade fork 3*f* of the fork number (n−1) is narrow. On the other hand, if the value of W1/W is greater than 0.6, then there is a problem in that a load shared by the blade forks 3*c*-3*e* of the fork numbers 3-5 is increased. By allowing the value of W1/W to fall within the range described above, it is possible to make the local stress of each of the blade forks appropriate.

Figure 5:
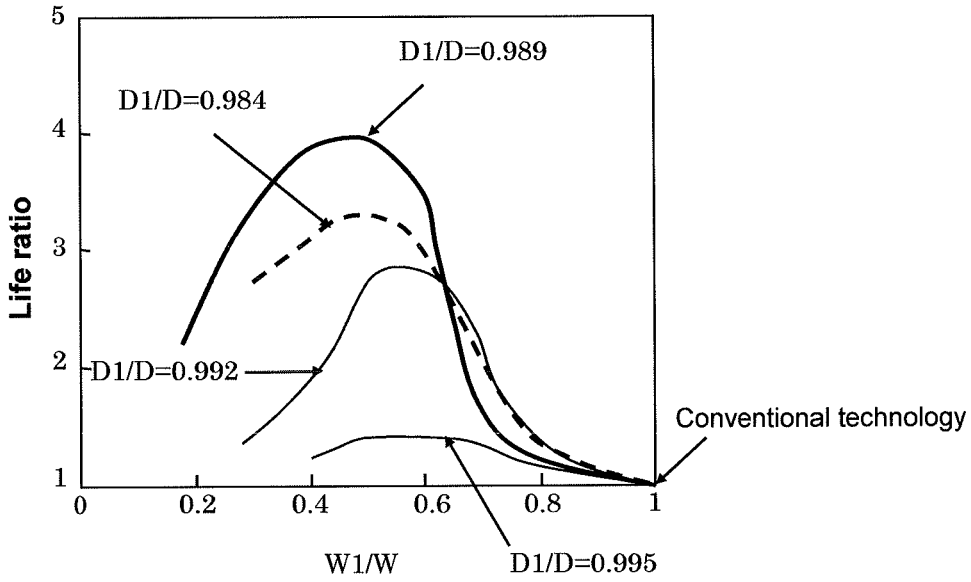
FIG. 5 is a characteristic chart in which the low-cycle fatigue life of the pin hole of the steam turbine according to the first embodiment of the present invention is analytically evaluated.
Figure 6:
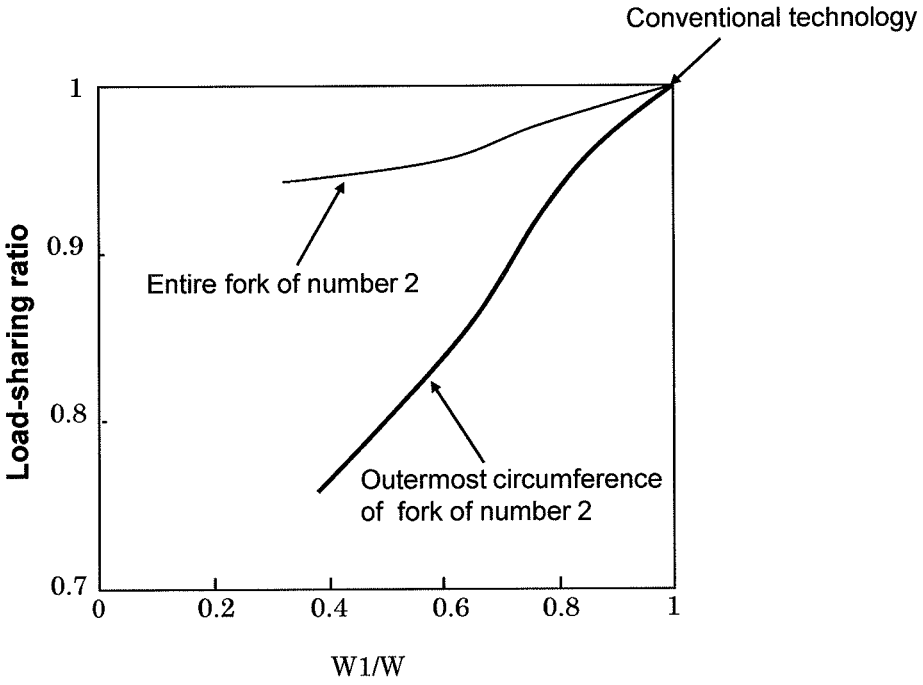
FIG. 6 is a characteristic chart in which a load shared by the pin hole of the steam turbine according to the first embodiment of the present invention is analytically evaluated.

To confirm the effect of the present invention, the low-cycle fatigue life of the pin hole was evaluated through a finite element analysis. The evaluation results are described by referring to FIGS. 5 and 6. FIG. 5 is a characteristic chart in which the low-cycle fatigue life of the pin hole of the steam turbine according to the first embodiment of the present invention is analytically evaluated. FIG. 6 is a characteristic chart in which a load shared by the pin hole of the steam turbine according to the first embodiment of the present invention is analytically evaluated. The same symbols in FIGS. 5 and 6 as those in FIGS. 1 to 4 denote like portions and their detailed explanations are omitted.

Analysis conditions are assumed as below. The number of the blade forks 3 is seven. The fork pin 5*a* associated with the blade forks of the fork numbers 2 and (n−1) on the outermost circumference in the radial direction is formed in the tapered shape. The following two points are considered as analytical parameters. A first point is the ratio (D1/D) of the minimum diameter D1 of the fork pin to the maximum diameter D of the fork pin. The minimum diameter D1 lies at the axial end on the side where the circumferential width on the convex (S) side of the blade fork 3*b* of the fork number 2 and of the fork number (n−1) is narrow (Such an axial end is the steam inlet end in the blade fork 3*b* of the fork number 2 and is the steam outlet end in the blade fork 3*f* of the fork number (n−1).). A second point is the ratio (W1/W) of the distance W1 to the axial width W of the blade fork. Such a distance W1 is between the start point from which the diameter of the fork pin 5*a* starts to reduce and the axial end on the side opposite a position where the circumferential width on the convex (S) side of the blade fork is narrow (Such an axial end is the steam outlet end in the blade fork 3*b* of the fork number 2 and is the steam inlet end in the blade fork 3*f* of the fork number (n−1).).

The longitudinal axis in FIG. 5 represents a ratio of the life of the pin hole 6*a* in the blade fork 3*b* of the fork number 2 with respect to the low-cycle fatigue life of a fork pin having a uniform diameter as a conventional technology if the low-cycle fatigue life is assumed as 1. As shown in FIG. 5, it is confirmed that the fork pin structure having the tapered portion according to the embodiment of the present invention has a longer life than that of the conventional structure. It is seen that the life-extension effect can particularly be produced in a region where the value of W1/W on the horizontal axis is between 0.3 and 0.6.

The life-extension effect of the present invention is remarkable in the region where the value of D1/D, i.e., the ratio of the diameters of the fork pin 5*a* is between 0.984 and 0.992. If the value of W1/W on the horizontal axis is small, local stress tends to increase at the C-point or E-point on the side where the circumferential width is narrow. On the other hand, if the value of W1/W is increased, local stress tends to increase at the F-point or G-point on the side opposite the C-point or the E-point, respectively.

The analytic results of load-sharing are shown in FIG. 6. FIG. 6 shows a comparative ratio of a load shared by the outermost circumferential pin hole 6*a*, in the radial direction 40, of the blade fork 3*b* of the fork number 2 to a load shared by the blade fork having a constant pin-diameter according to the conventional technology. In addition, FIG. 6 shows a comparative ratio of a load shared by the overall blade fork 3*b* of the fork number 2 to a load shared by the blade fork having a constant pin-diameter according to the conventional technology. As shown in FIG. 6, it is confirmed that as the value of the size ratio (W1/W) is reduced, the load-sharing ratio of the blade fork 3*b* of the fork number 2 is decreased. If the value of W1/W is excessively reduced, a load shared by each of the blade forks 3*c*-3*e* of the fork numbers 3-5 located in the axial central portion is increased. Taking this fact into account, it is desirable to make appropriate not only the axial stress distribution of the blade fork into which the fork pin 5*a* having the tapered portion is inserted but also the local stress of the overall blade fork.

In general, a titanium alloy has a higher fatigue crack propagation rate than steel. Therefore, if the turbine blade is made of a titanium alloy such as Ti-6Al-4V, by applying the present invention to the turbine blade made of a titanium alloy, it can be expected to have a longer operating life than the turbine blade made of steel.

The first embodiment of the steam turbine according to the present invention reduces the load shared by the portion C where the circumferential width on the convex side of the blade fork 3*b* of the fork number 2 is narrower than that on the concave side thereof. The blade fork 3*b* of the fork number 2 is formed in the region where the circumferential position of the platform of the turbine blade 1 is varied between the steam inlet end and the axial central portion and between the steam outlet end and the axial central portion. In this way, the local stress of the pin hole 6*a* can be reduced. Thus, the steam turbine provided with the fork-type blade attachment can be provided that has highly-reliability on the low-cycle fatigue and on the stress corrosion cracking and that has a longer operating life.

Incidentally, the case where the fork pin 5*a* located on the outermost circumference in the radial direction 40 adopts the tapered pin is described in the present embodiment. However, the present invention is not limited to this. For example, although the fork pin 5*b* located at the center in the radial direction or the fork pin 5*c* located on the innermost circumference adopts a fork pin having the tapered portion formed as described above, the same stress reduction effect can be produced.

Second Embodiment

Figure 7:
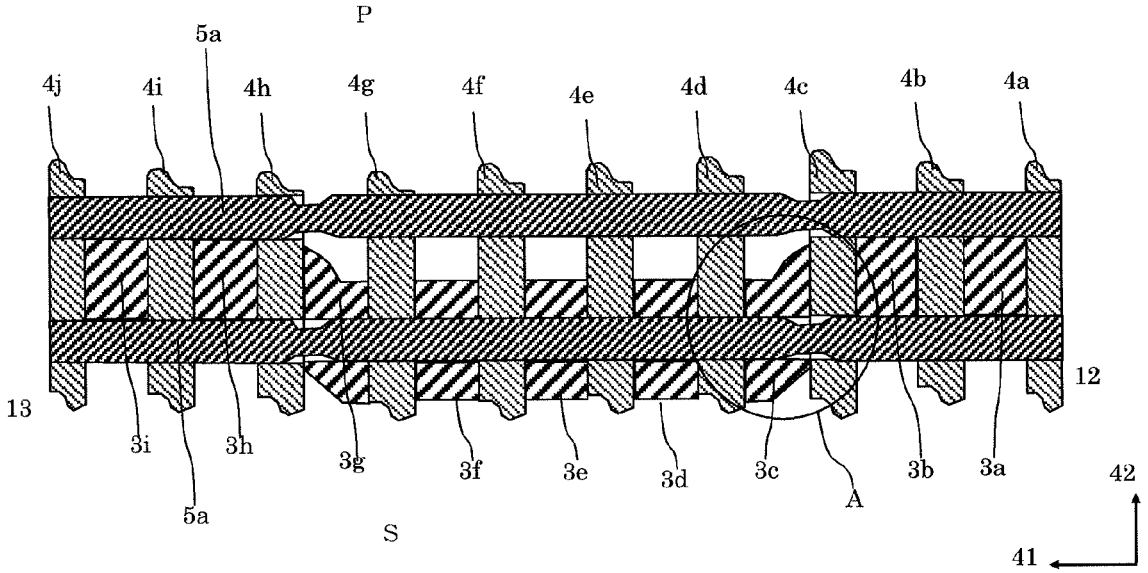
FIG. 7 is a transverse cross-sectional view of a joint structure of a turbine blade and a turbine rotor of the steam turbine according to a second embodiment of the present invention.
Figure 8:
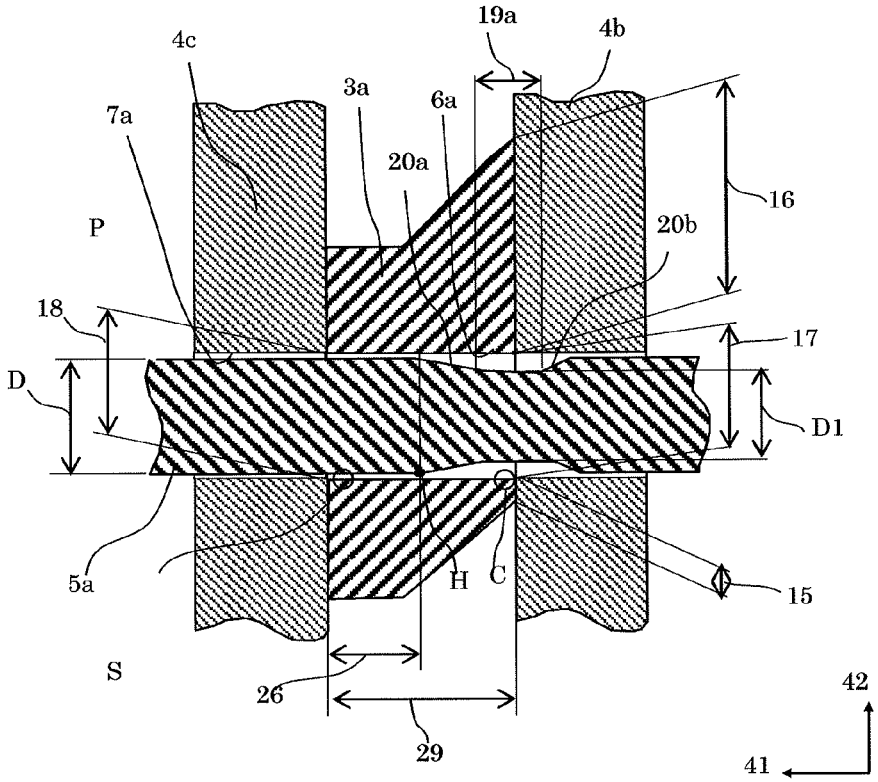
FIG. 8 is a transverse cross-sectional view of an enlarged A-portion of the joint structure of the turbine blade and the turbine rotor shown in FIG. 7.

A second embodiment of the steam turbine according to the present invention is hereinafter described with reference to the drawings. FIG. 7 is a transverse cross-sectional view of a joint structure of a turbine blade and a turbine rotor of the steam turbine according to the second embodiment. FIG. 8 is a transverse cross-sectional view of an enlarged A-portion of the joint structure of the turbine blade and the turbine rotor shown in FIG. 7. In FIGS. 7 and 8 the same reference numerals as those in FIGS. 1 thru 6 denote like portions; therefore, their detailed explanations are omitted.

FIG. 7 shows the second embodiment in which nine blade forks 3 are disposed in the axial direction 41 and ten rotor forks 4 are disposed in the axial direction 41. A third blade fork 3*c* of the fork number 3 from the steam inlet side is formed in a region where the position, in the circumferential direction 42, of the platform of the turbine blade 1 is changed between the axial inlet end 12 and the axial central portion 11. A third blade fork 3*g* of fork number (n−2) from the outlet side is formed in a region where the position, in the circumferential direction 42, of the platform of the turbine blade 1 is changed between the axial output end 13 and the axial central portion 11. The structure as described above is adopted in some cases if the blade is elongated and centrifugal force born by the fork structure is large.

Referring to FIG. 8, a clearance (17-D1) is formed larger than a clearance (18-D). The clearance (17-D1) is defined between an inner diameter 17 of a pin hole 16*a* at the steam inlet end of the blade fork 3*c* of the fork number 3 and a diameter D1 of the fork pin 5*a* at the steam inlet end of the blade fork 3*c* of the fork number 3. In addition, the clearance (18-D) is defined between an inner diameter 18 of a pin hole 6*a* at an outlet end of the blade fork 3*c* of the fork number 3 and the diameter D of the fork pin 5*a*. This case shows an example as below. The inner diameter 17 of the pin hole 6*a* at the inlet end of the blade fork 3*c* of the fork number 3 is equal to the inner diameter 18 of the outlet end. Therefore, the diameter D1 of the fork pin 5*a* at the inlet end of the blade fork 3*c* of the fork number 3 is formed smaller than the diameter D of the outlet end. A third blade fork 3*g* of the fork number (n−2) from the steam outlet end is formed symmetrically in the axial direction 41 to the blade fork 3*c* of the fork number 3.

Similarly to the description of the first embodiment, the structure of the present embodiment can also reduce a contact pressure at a portion where the circumferential width in the blade fork pin 6*a* is narrow, thereby reducing local stress.

The second embodiment of the steam turbine according to the present invention described above can produce the same effect as that of the first embodiment described above.

Third Embodiment

Figure 9:
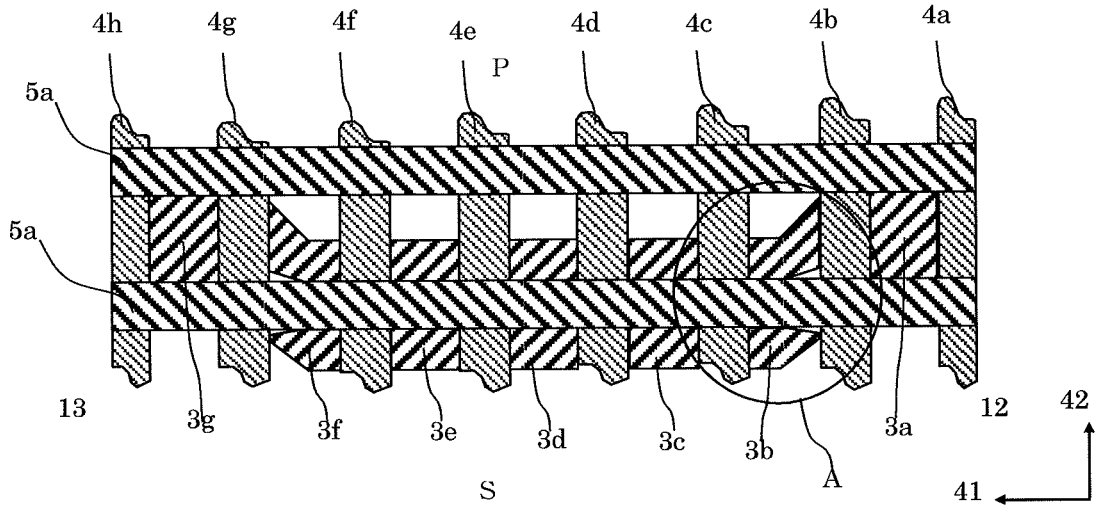
FIG. 9 is a transverse cross-sectional view of a joint structure of a turbine blade and a turbine rotor of the steam turbine according to a third embodiment of the present invention.
Figure 10:
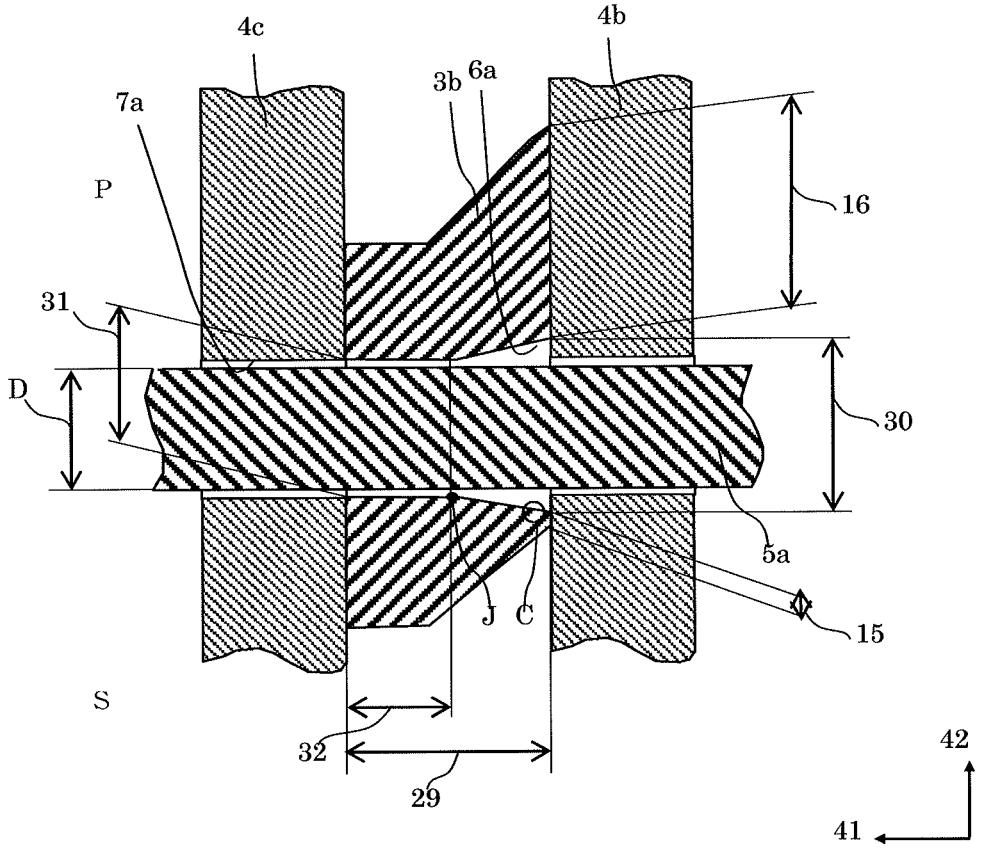
FIG. 10 is a transverse cross-sectional view of an enlarged A-portion of the joint structure of the turbine blade and the turbine rotor shown in FIG. 9.

A third embodiment of the steam turbine according to the present invention is hereinafter described with reference to the drawings. FIG. 9 is a transverse cross-sectional view of a joint structure of a turbine blade and a turbine rotor of the steam turbine according to the third embodiment. FIG. 10 is a transverse cross-sectional view of an enlarged A-portion of the joint structure of the turbine blade and the turbine rotor shown in FIG. 9. In FIGS. 9 and 10 the same reference numerals as those in FIGS. 1 thru 8 denote like portions; therefore, their detailed explanations are omitted.

FIG. 9 shows a case where seven blade forks 3 are disposed in the axial direction 41 in the third embodiment. A second blade fork 3*b* of the fork number 2 from the steam inlet side is formed in a region where the position, in the circumferential direction 42, of the platform of the turbine blade 1 is changed between the axial inlet end 12 and the axial central portion 11.

As shown in FIG. 10, a circumferential width 15 of a convex (S) side end surface at the steam inlet end of the blade fork 3*b* of the fork number 2 is smaller than a circumferential width 16 of a concave (P) side end surface. The present embodiment has features as below. A diameter D of the fork pin 5*a* is constant in the axial direction 41. In addition, an inner diameter 30 of the pin hole 6*a* at the steam inlet end of the second blade fork 3*b* of the fork number 2 from the steam inlet side is formed larger than an inner diameter 31 of the pin hole 6*a* at the outlet end. In other words, a clearance (30-D) between the inner diameter 30 of the pin hole 6*a* at the steam inlet end of the blade fork 3*b* of the fork number 2 and the diameter (D) of the fork pin 5*a* is formed greater than a clearance (31-D) between the inner diameter 31 of the pin hole 6*a* at the steam outlet end of the blade fork 3*b* of fork number 2 and the diameter D of the fork pin 5*a*.

With the structure described above, similarly to the first embodiment, also the structure of the present embodiment has an effect of reducing a contact pressure on the steam inlet side of the blade fork 3*b* of fork number 2, thereby reducing local stress at the C-point where the width in the circumferential direction 42 is narrow.

In the blade fork 3*b* of the fork number 2 shown in FIG. 10, it is desirable that a value of a ratio of a distance 32 to a width 29, in the axial direction 41, of the blade fork 3*b* of the fork number 2 be between 0.3 and 0.6. The distance 32 is defined as from the point J from which the inner diameter of the pin hole 6*a* starts to increase in the axial direction to the steam outlet end of the blade fork 3*b* of the fork number 2.

It is desirable that a value of a ratio of the inner diameter 30 of the pin hole 6*a* at the steam inlet end of the blade fork 3*b* of fork number 2 to the diameter D of the fork pin 5*a* be between 0.984 and 0.992.

It is desirable to perform local burnishing as a method of enlarging the inner diameter of the pin hole. The burnishing can apply compressive residual stress to the pin hole; therefore, an effect can be expected in which the compressive residual stress thus applied extends an operating life with respect to low-cycle fatigue and stress corrosion cracking.

Also the second blade fork 3*f* of the fork number (n−1) from the steam outlet side is shaped symmetrically in the axial direction to the blade fork 3*b* of the fork number 2. Thus, the second blade fork 3*f* of the fork number (n−1) can produce the same effect as that of the blade fork 3*b* of the fork number 2.

The third embodiment of the steam turbine according to the present invention can produce the same effect as that of the first embodiment described above.

According to the third embodiment of the steam turbine of the present invention described above, the blade fork 3*b* of the fork number 2 is formed in the region where the position, in the circumferential direction 42, of the platform of the turbine blade 1 is changed between the steam inlet end and the axial central portion and between the steam outlet end and the axial central portion. In the blade fork 3*b* of the fork number 2, the value of the ratio of the inner diameter 30 of the pin hole 6*a* at the steam inlet end of the blade fork 3*b* of the fork number 2 to the diameter D of the fork pin 5*a* is between 0.984 and 0.992. This can make appropriate the stress distribution at the axial position of the pin hole 6*a*. As a result, the steam turbine provided with the fork-type blade attachment can be provided that has high reliability on low-cycle fatigue and stress corrosion cracking and has an extended operating life.

The two portions between the tapered portion 20*a* and the parallel portion 19*a* of the small pin-diameter region and between the tapered portion 20*b* and the parallel portion 19*a* are smoothly and circularly processed. However, a single small pin-diameter region may be smoothly and circularly processed.

In the embodiments of the present invention described above, the parallel portion 19*a* is formed over the full outer circumference of the fork pin 5*a*. However, for example, a partial recessed portion may circumferentially be formed in the outer circumferential surface of the fork pin at a position facing the C-point on the end side of the pin hole 6*a* where the circumferential width of the blade fork is narrow.

What is claimed is:

1. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of fork pins insertable through the pin holes of the blade forks and the rotor forks in the axial direction of the turbine rotor, wherein a clearance between an inner diameter of one of the pin holes of one of the blade forks and a diameter of one of the fork pins varies depending on a position in the axial direction of the turbine rotor, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial steam inlet end and the axial central portion, and at least one of the pin holes, being in a different radial position of one of the blade forks, is formed so that a clearance between an inner diameter of one of the pin holes at the steam inlet end and the diameter of one of the fork pins is formed to be greater than a clearance between an inner diameter of one of the pin holes at a portion that differs in axial position of one of the blade forks and the diameter of one of the fork pins.

2. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of fork pins insertable through the pin holes of the blade forks and the rotor forks in the axial direction of the turbine rotor, wherein a diameter of one of the fork pins varies depending on a position in the axial position of the turbine rotor, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial steam inlet end and the axial central portion, and one of the fork pins, insertable into at least one of the pin holes being in a different radial position of one of the blade forks, is formed so that the diameter of one of the fork pins at the steam inlet end is smaller than the diameter of one of the fork pins at a different axial position.

3. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of forks pins insertable through the pin holes of the blade forks and the rotor forks in the axial direction of the turbine rotor, wherein a clearance between an inner diameter of one of the pin holes of one of the blade forks and a diameter of one of the fork pins varies depending on a position in the axial direction of the turbine rotor, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial steam outlet end and the axial central portion, and at least one of the pin holes, being in a different radial position of one of the blade forks, is formed so that a clearance between an inner diameter of one of the pin holes at the steam outlet end and the diameter of one of the fork pins is formed to be greater than a clearance between an inner diameter of one of the pin holes at a portion that differs in axial position of one of the blade forks and the diameter of one of the fork pins.

4. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of forks pins insertable through the pin holes of the blade forks and the rotor forks in the axial direction of the turbine rotor, wherein a diameter of one of the fork pins varies depending on position in the axial position of the turbine rotor, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial steam outlet end and the axial central portion, and one of the fork pins, insertable into at least one of the pin holes, being in a different radial position of one of the blade forks, is formed so that the diameter of one of the fork pins at the steam outlet end is smaller than the diameter of one of the fork pins at a different axial position.

5. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of forks pins insertable through the pin holes of the blade forks and the rotor forks in the axial direction of the turbine rotor, wherein a diameter of one of the fork pins varies depending on a position in the axial position of the turbine rotor, one of the fork pins has a small-diameter portion, the small-diameter portion including a parallel portion formed with an axially constant diameter and a tapered portion formed to increase in diameter in an axial direction from the parallel portion, an intersection between the parallel portion and the tapered portion is smoothly and circularly formed, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial steam inlet end and the axial central portion, and one of the fork pins, insertable into at least one of the pin holes being in a different radial position of one of the blade forks, is configured such that a value of a ratio obtained by dividing an axial distance between a start point from which a pin-diameter starts to decrease in an axial direction and the steam outlet end by an axial width of one of the blade forks is between 0.3 and 0.6.

6. A steam turbine comprising:

a turbine rotor having rotor forks rowed in an axial direction;

a turbine blade having blade forks rowed in the axial direction of the turbine rotor, the blade forks being engaged with the rotor forks;

a plurality of aligned pin holes formed in the blade forks and the rotor forks; and a plurality of fork pins insertable through the pin holes of the blade forks and the rotor forks in the axial direction of the turbine rotor, wherein a diameter of one of the fork pins varies depending on a position in the axial direction of the turbine rotor, one of the fork pins has a small-diameter portion, the small-diameter portion including a parallel portion formed with an axially constant diameter and a tapered portion formed to increase in diameter in an axial direction from the parallel portion, an intersection between the parallel portion and the tapered portion is smoothly and circularly formed, the turbine blade includes a platform having an axial central portion located closer to a circumferential convex side than to an axial steam inlet end and an axial steam outlet end, one of the blade forks is formed in a region where a circumferential position of the platform of the turbine blade changes between the axial outlet end and the axial central portion, and one of the fork pins, insertable into at least one of the pin holes being in a different radial position of one of the blade forks, is configured such that a value of a ratio obtained by dividing an axial distance between a start point from which a pin-diameter starts to decrease in an axial direction and the steam inlet end by an axial width of one of the blade forks is between 0.3 and 0.6.

* * * * *